US008308054B2

(12) United States Patent
Jones et al.

(10) Patent No.: US 8,308,054 B2
(45) Date of Patent: Nov. 13, 2012

(54) CUSTOMIZABLE FOLDER

(75) Inventors: Braden Jones, Phoenix, AZ (US); Juliet Kenney, New York, NY (US); Lauren Grassia, East Northport, NY (US)

(73) Assignee: Esselte Corporation, Melville, NY (US)

( * ) Notice: Subject to any disclaimer, the term of this patent is extended or adjusted under 35 U.S.C. 154(b) by 1126 days.

(21) Appl. No.: 12/121,678

(22) Filed: May 15, 2008

(65) Prior Publication Data

US 2009/0283576 A1 Nov. 19, 2009

(51) Int. Cl.

| | |
|---|---|
| ***B65D 27/00*** | (2006.01) |
| ***B42D 3/00*** | (2006.01) |
| ***B42D 5/00*** | (2006.01) |
| ***B42F 21/00*** | (2006.01) |
| ***G09F 3/02*** | (2006.01) |
| ***G09F 23/10*** | (2006.01) |

(52) U.S. Cl. ..... 229/67.1; 229/67.2; 229/67.3; 229/67.4; 281/37; 281/41; 40/359; 40/360; 40/630; 40/641

(58) Field of Classification Search ..... 229/67.1, 229/67.2, 67.3, 67.5, 67.4; 281/37, 41; 40/359, 40/360, 630, 641

See application file for complete search history.

(56) References Cited

U.S. PATENT DOCUMENTS

| | | | | |
|---|---|---|---|---|
| D28,173 | S | 1/1898 | Meil, Jr. | |
| 819,464 | A * | 5/1906 | Smead | 229/67.4 |
| 1,507,433 | A * | 9/1924 | Schaffert | 40/359 |
| 2,035,218 | A | 3/1936 | Bloom | 229/71 |
| 4,184,699 | A * | 1/1980 | Lowe, Jr. | 281/41 |
| 4,201,403 | A * | 5/1980 | Turner | 283/74 |
| 4,576,328 | A * | 3/1986 | Snider et al. | 229/67.1 |
| 5,016,370 | A * | 5/1991 | Rhian et al. | 40/359 |
| 5,025,978 | A | 6/1991 | Pacione | 229/1.5 R |
| 5,341,982 | A * | 8/1994 | Syers | 229/67.1 |
| 5,468,085 | A * | 11/1995 | Kline | 402/79 |
| 5,518,273 | A * | 5/1996 | Olson | 283/36 |
| 5,988,685 | A | 11/1999 | Magelonsky et al. | 281/31 |
| 6,039,354 | A * | 3/2000 | Mangler | 281/38 |
| 6,328,338 | B1 * | 12/2001 | Sherman et al. | 281/42 |
| 6,390,714 | B1 | 5/2002 | Bradley et al. | 402/79 |
| 6,764,242 | B1 | 7/2004 | Karten et al. | 402/73 |
| 6,913,188 | B2 | 7/2005 | Wong et al. | 229/67.1 |
| 2005/0067829 | A1 | 3/2005 | Mally | 281/29 |
| 2005/0156017 | A1 | 7/2005 | Crum et al. | 229/67.1 |
| 2006/0278686 | A1 * | 12/2006 | Rittmann | 229/67.3 |
| 2007/0085327 | A1 | 4/2007 | Russo | 281/21.1 |

* cited by examiner

*Primary Examiner* — Nathan J Newhouse
*Assistant Examiner* — Derek Battisti
(74) *Attorney, Agent, or Firm* — Dorsey & Whitney LLP

(57) ABSTRACT

A customizable folder is disclosed. The folder has an edge portion missing from a cover thereof, and is adapted to receive thereto a complementary piece to complete the space formed by the missing edge portion. Also disclosed is a kit for a customizable folder comprising a customizable folder and a plurality of complementary pieces.

25 Claims, 7 Drawing Sheets

CUSTOMIZABLE FOLDER

FIELD OF INVENTION

The present invention relates to a folder and more particularly to a folder with a customizable cover.

BACKGROUND OF THE INVENTION

Stock folders are known and are provided in several standard configurations. For example, stock portfolio folders are typically created from a blank of material by folding the blank, usually centrally, to form two relatively equal cover panels. Pockets can be formed on an inner face of the blank, such as by folding over a portion of the blank and adhering it to its side edges. Because stock folders are formed from a generic stock inventory, the user has virtually no opportunity to customize the folder configuration after the folders are manufactured.

Attempts have been made to personalize generic stock folders. For example, U.S. Pat. No. 5,025,978 discloses a two-piece folder with a separate front panel, such that the front panel is secured to the rear panel after being printed with printed material. U.S. Pat. No. 5,882,038 discloses providing die cut windows in the blank so that a personalized sheet can be inserted and visible through the windows. U.S. Publication No. 2005/0067829 discloses a fabric cover for enclosing a folder. U.S. Publication No. 2005/0156017 discloses providing a folder with separate imprintable pocket pieces.

There is a need for a folder that is easily customizable by the user.

SUMMARY OF THE INVENTION

The invention relates to a customizable filing device, such as folders, binders, and dividers, that has a customizable cover adapted to change the exterior appearance of the device.

In an embodiment, the device is a customizable folder comprising a first panel having a first predetermined shape and a second panel having a second predetermined shape, the two panels being hinged to each other along a hinge line. An edge portion, such as a corner edge portion, is missing from the first predetermined shape of the first panel, and the first panel is adapted to receive thereto a complementary piece configured to complete the first predetermined shape. Preferably, the first and second predetermined shapes are substantially the same, and are regular shapes such as rectangular shapes. The complementary piece can have a similar or different appearance compared to the first panel. In a further embodiment, one or more edge portions are missing from both the first and second predetermined shapes.

The complementary piece is preferably adhesively attached to the folder panel. An adhesive can be disposed on a surface of the panel and/or the complementary piece, and an optional removable protective cover can be provided over the adhesive.

In an embodiment, an edge portion of the first and/or second panel is defined by a line of weakness for detachment from the panel, and the panel is adapted to receive thereto a complementary piece configured to complete the space formed in the panel when the edge portion is removed therefrom.

In an embodiment, a kit for a customizable folder is provided. The kit comprises a folder having an edge portion missing from a panel thereof and one or more complementary pieces each configured to be attached to the panel to substantially complete the rectangular shape of the panel.

The invention thus provides easy-to-apply customization options to a user.

BRIEF DESCRIPTION OF THE DRAWINGS

The invention will be better understood with reference to the attached drawings illustrating preferred embodiments, wherein.

DETAILED DESCRIPTION OF THE PREFERRED EMBODIMENTS

While customizable folders are described in the following description, it will be appreciated that any suitable filing device, such as binders, dividers, notebooks, and the like, can be customizable features according to the invention. Also, although the present customizable feature is described in connection with folder cover panels, it will be appreciated that other parts of folders and other filing devices, e.g., indexing sheets inside folders and binders, can include the customizable feature according to the invention.

Figure 1:
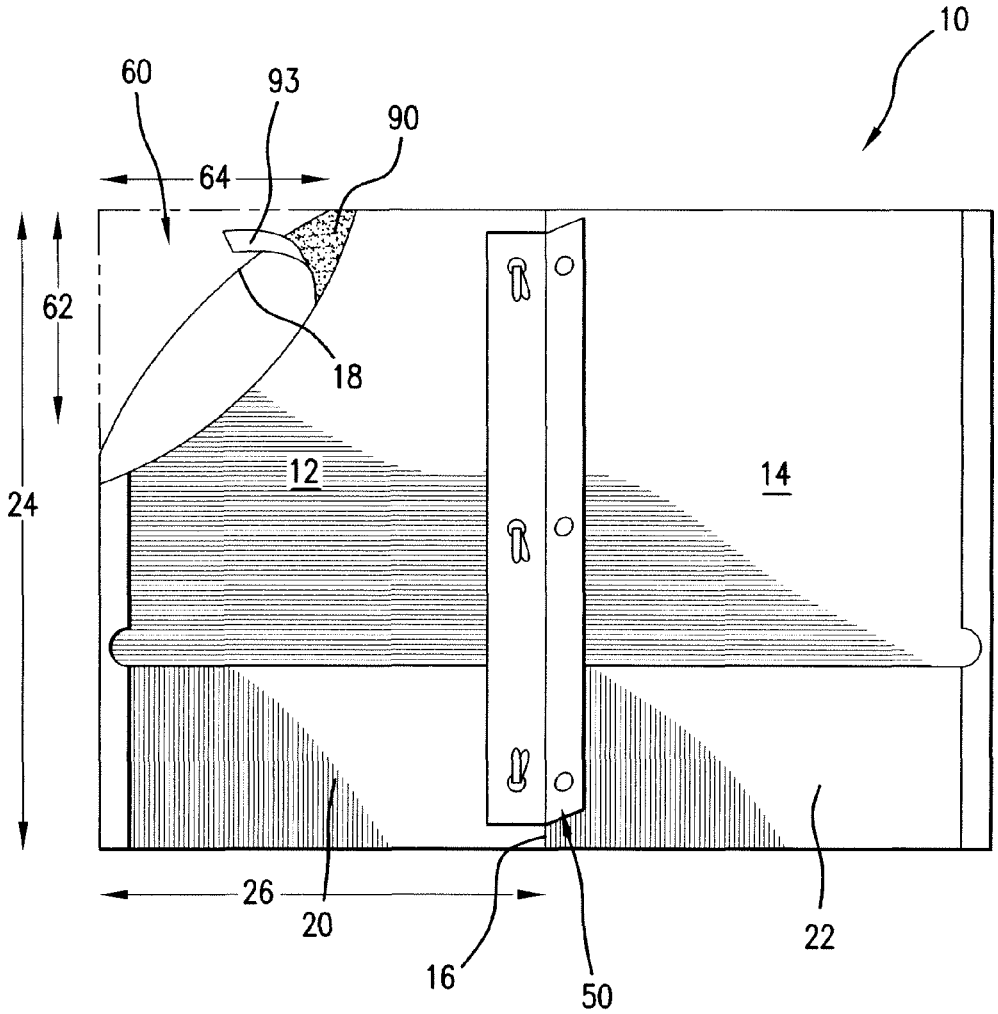
FIGS. 1-3 are plain views of customizable folders constructed according to embodiments of the invention.

In FIG. 1, a customizable folder 10 is shown. The folder 10 includes a pair of flat cover panels 12,14. The folder 10 can have any suitable size and shape, and can be made of any suitable material. The folder 10 is preferably made of a material that is sufficiently rigid to resist bending and sufficiently resilient to withstand handling by the user. Preferred materials include paper (e.g., paperboard), lightweight plastic (e.g., thermoplastic such as polypropylene and PVC), and metal.

For example, the folder 10 can have a conventional portfolio folder size and can be formed from a single blank of paperboard material. The blank has a top edge, a bottom edge, and a pair of side edges, which form the top, bottom, and side edges of the folder 10, respectively, and first and second faces, which form the inner and outer faces of the folder 10, respectively. The blank is folded along a fold line 16 to hingedly define the first and second panels 12,14, such that the panels 12,14 are interconnected to each other along the fold line 16. The panels 12,14 are thus hingedly associated along the fold line 16 for pivotal movement between a closed position, in which the first panel 12 is placed over the second panel 14, and an open position, in which the first panel 12 extends at an angle from the second panel 14.

Figure 7:
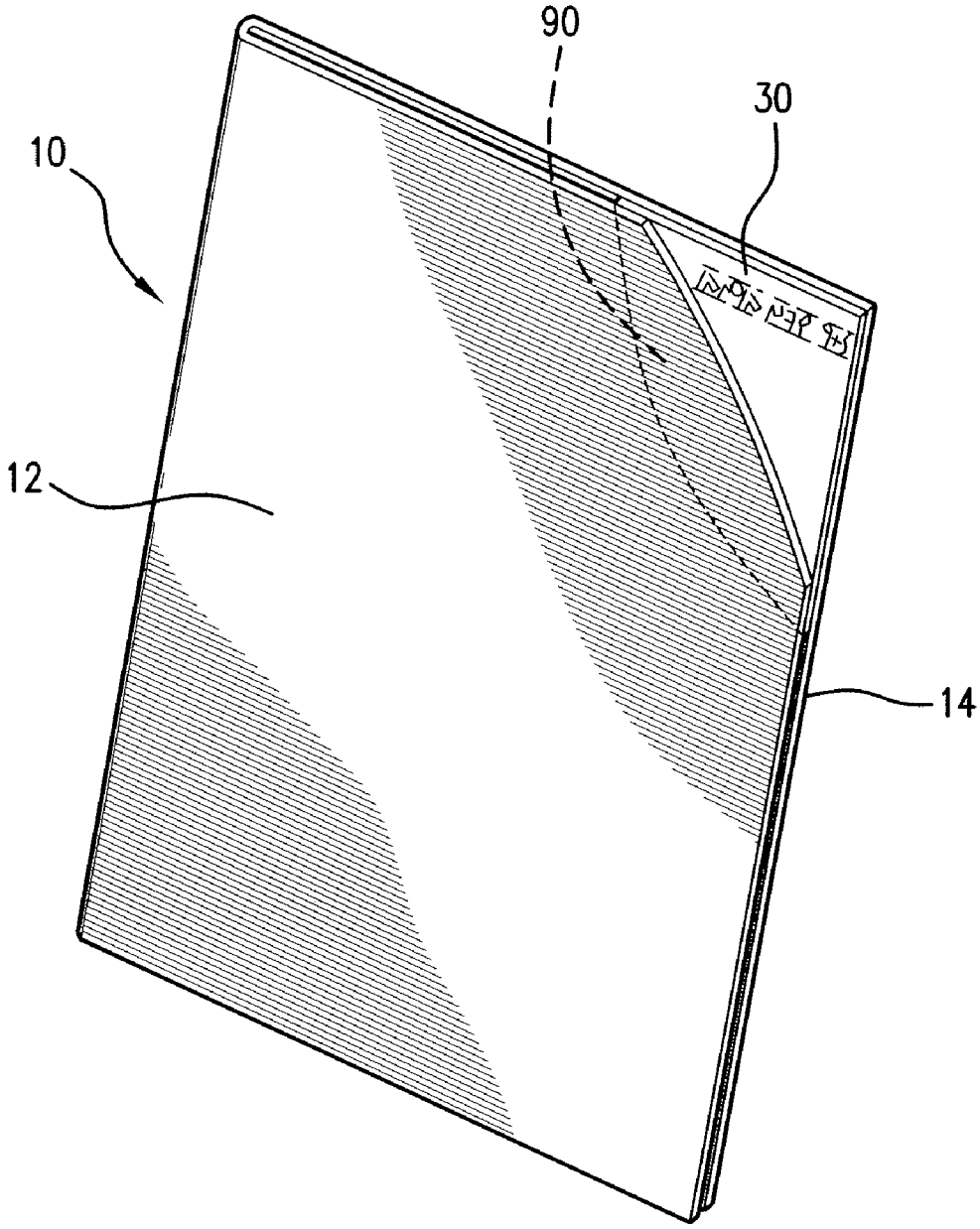
FIG. 7 is a perspective view of the assembled kit of FIG. 6.

The panels 12,14 can have any desired and suitable exterior shape. Preferably, the first and second panels 12,14 are configured to have first and second predetermined exterior shapes, respectively, when viewed in planform or from their front or back. In preferred embodiments, the first and second predetermined shapes are the same or substantially the same, and the size is also preferably substantially the same or close to being the same, such that a portion missing from the shape of one of the covers is easily, and most preferably immediately recognizable, as shown for example in FIG. 7. Preferably, the first and second predetermined shapes are each a regular shape, a shape defined by substantially linear boundaries, or a shape resembling the shape of documents to be contained in the folder 10. More preferably, the first and second predetermined shapes are substantially rectangular, although other shapes can be used.

At least one of the panels 12,14 has one or more portions 60 missing from an edge of its predetermined exterior shape. In FIG. 1, the first panel 12 is shown as having a rectangular shape with a corner edge portion 60 missing therefrom. In other embodiments, the panel 12 can have a missing edge portion between corners of the panel 12, e.g., at a portion of the top, bottom, or side edge of the panel 12 distanced from the corners. A missing edge portion 60 is most preferably at any free edge of the panel 12, i.e., any edge that is not joined to the second panel 14 in the preferred embodiment. Preferably the corner is disposed remote from or opposite the hinge.

Figure 2:
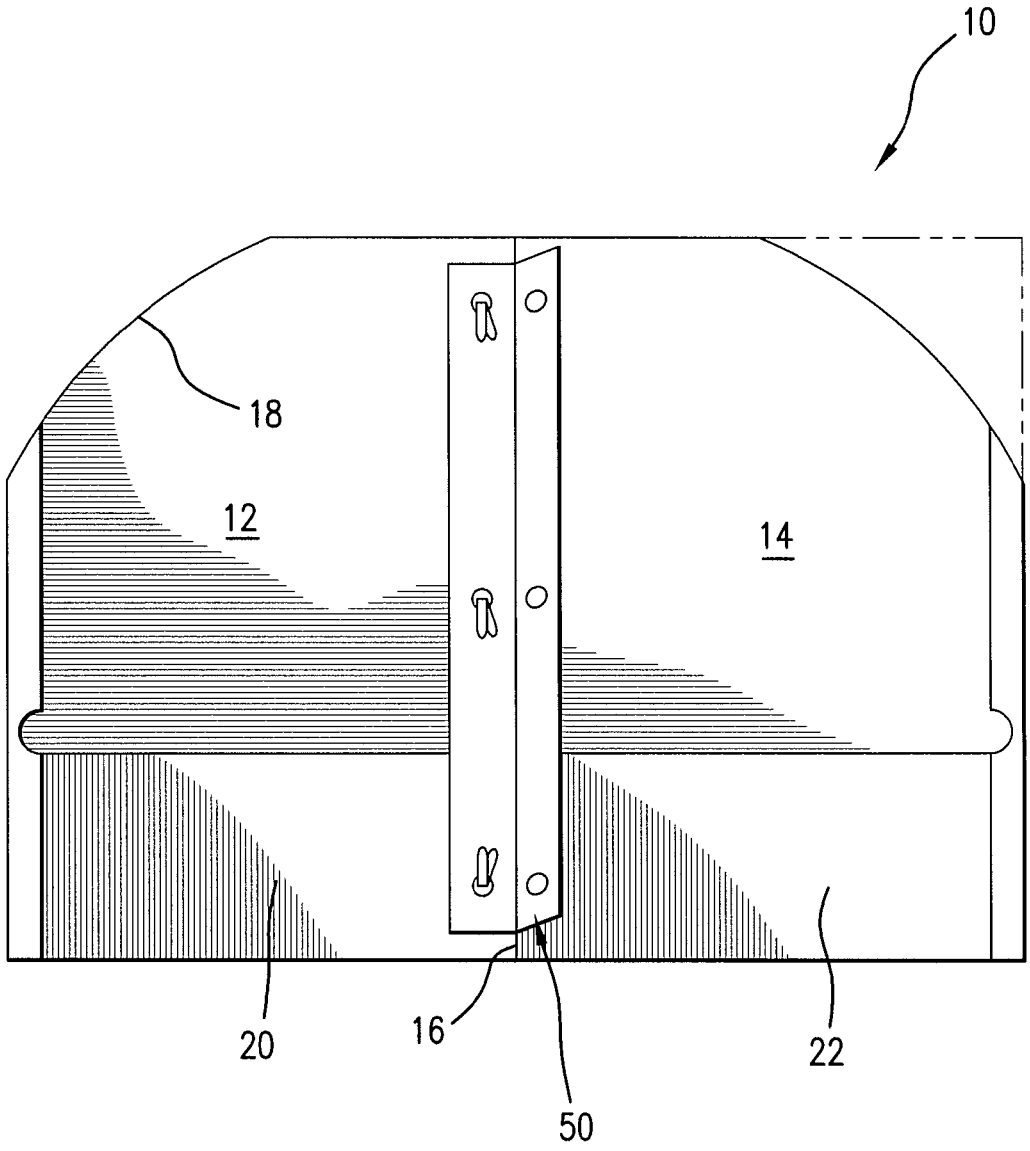
Figure 3:
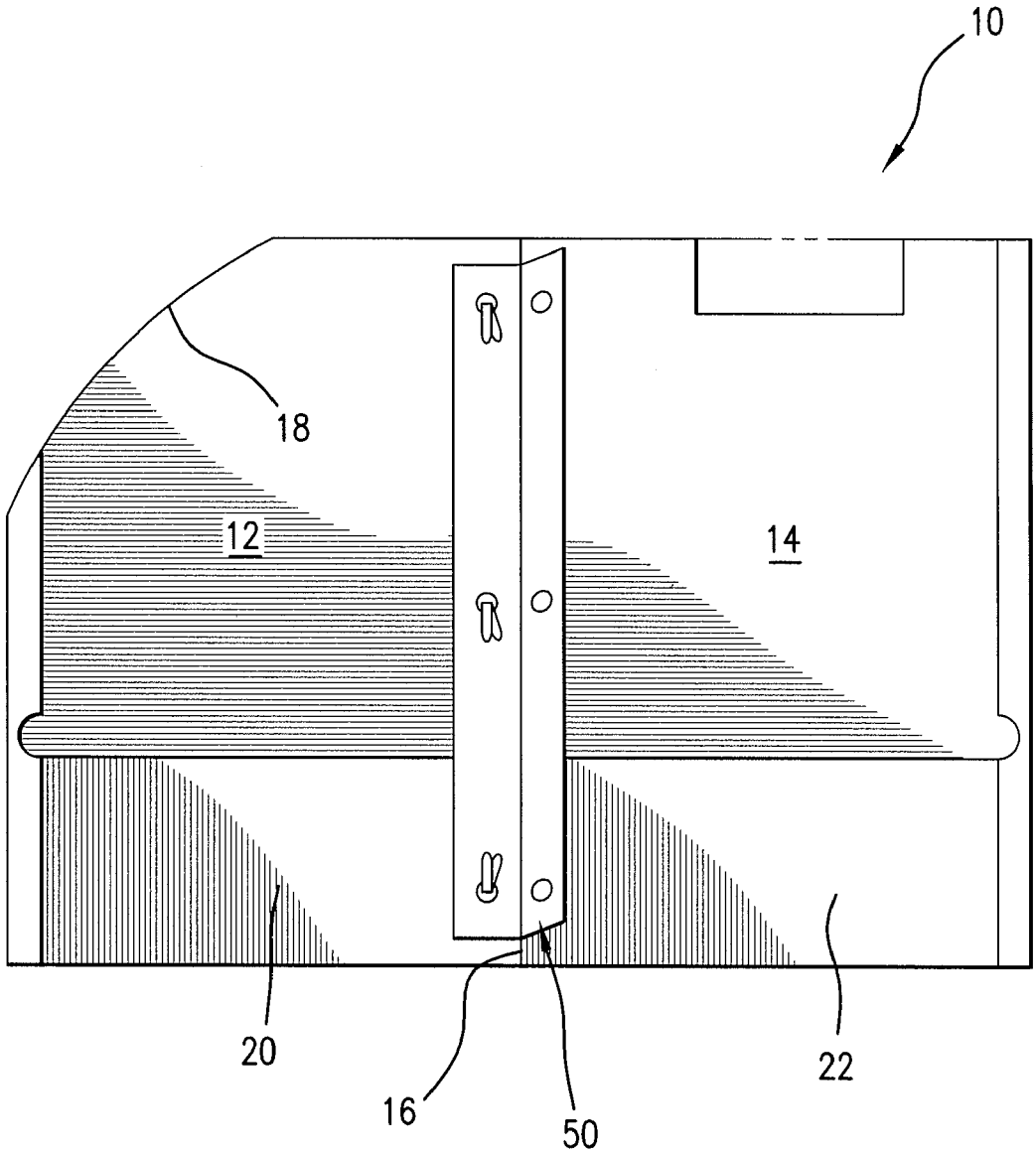

In an embodiment, both panels 12,14 can each include a missing edge portion 60 as shown in FIGS. 2 and 3. Missing edge portions 60 can be formed at corresponding edges of the panels 12,14, e.g., at the top corner of the panels 12,14 as shown in FIG. 2, such that the shapes of the panels 12,14 are mirror images of each other. Alternatively, missing edge portions 60 can be formed at non-corresponding edges of the panels 12,14, e.g., at a corner of the first panel 12 and between corners of the second panel 14, as shown in FIG. 3.

The missing edge portion 60 can be provided by any suitable method. For example, when the panels 12,14 are formed by folding a single blank of paperboard material along the fold line 16, a portion of the blank material corresponding to the edge portion 60 can be removed, such as by cutting, before or after the material is folded along the fold line 16. In another embodiment, a line of weakness, such as a score line, that defines an edge portions 60 can be provided on the panel 12, such that the user can remove the edge portion 60 as desired, such as by tearing off by hand. One or more edge portions 60, of any desired configurations, can be defined with multiple lines of weakness, so that the user can select the desired size and configuration of the edge portion(s) 60 to be removed.

The missing edge portion 60 can have any desired and suitable configuration. In the embodiment shown in FIG. 1, the missing edge portion 60 is substantially triangular but has a curved edge 18. In another embodiment shown in FIG. 3, one of the missing edge portions 60 has a rectangular configuration. Other configurations, such as circular or trapezoidal configurations, can be used in other embodiments.

The missing edge portion 60 can have any desired and suitable dimensions. In an embodiment, the missing edge portion 60 has a length 62 that is preferably at least about ⅕ of the length 24 of the panel 12, more preferably at least about ⅓ of the length 24, and preferably at most about ⅔ of the length 24, more preferably at most about ½ of the length 24. The width 64 of the missing edge portion 60 is preferably at least about ⅕ of the width 26 of the panel 12, more preferably at least about ⅓ of the width 26, and preferably at most about ⅔ of the width 26. Other dimensions can be used in other embodiments.

Figure 4:
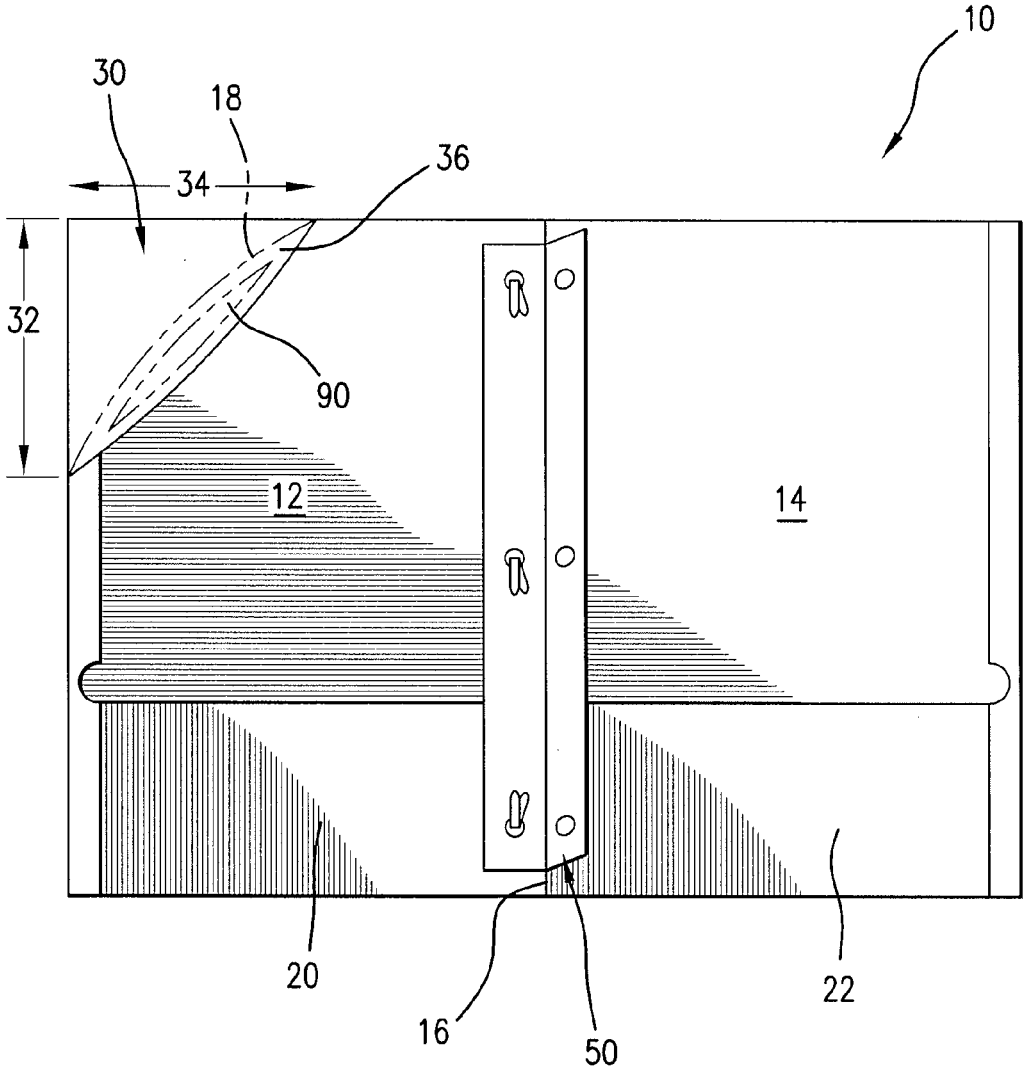
FIG. 4 is a plain view of a customizable folder with a complementary piece attached thereto according to an embodiment of the invention.

The first panel 12 is adapted to receive thereto a complementary piece 30 configured to complete the first predetermined shape. As shown in FIG. 4, the complementary piece 30 is preferably sized and configured to cover the area defined by the missing edge portion 60, and to extend over a part of the panel 12 to define an overlapping area 36. For example, the complementary piece 30 has a length 32 and a width 34 that are at least coextensive with, and preferably greater than, the length 62 and width 64, respectively, of the missing edge portion 60. Consequently, the complementary piece 30 completes the corner edge portion 60 such that the resulting first panel 12 is substantially identical in size and shape with the second panels 14. In this embodiment, the edges of the complementary piece 30 are substantially flush with the corresponding edges of the first panel 12.

Figure 5:
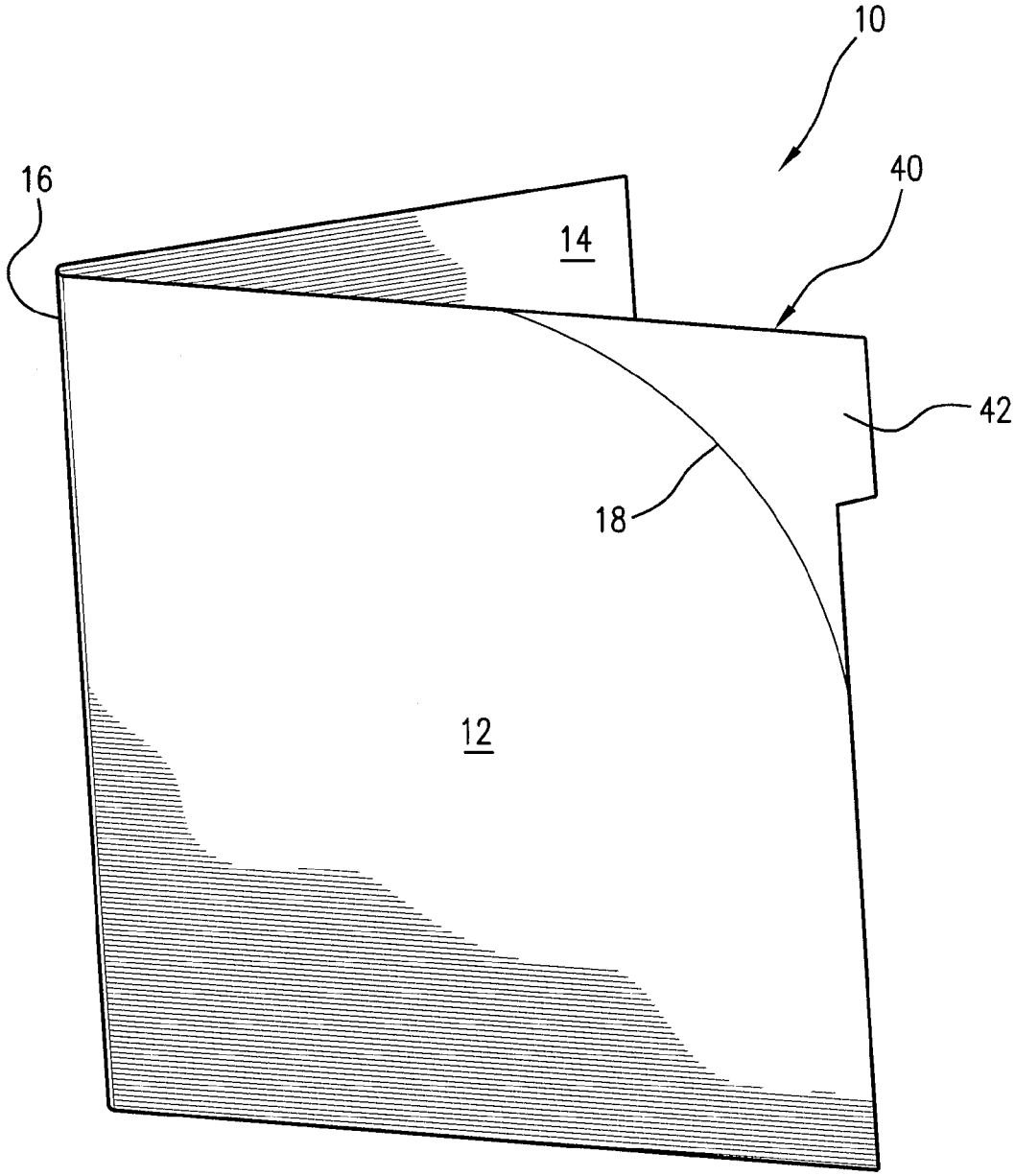
FIG. 5 is a perspective view of a customizable folder with a complementary piece attached thereto according to another embodiment of the invention.

In other embodiments, the complementary piece 30 can be configured to include additional structural features as suitable and desired. Such additional structural features can be provided as unitary constructions with the complementary piece 30, or as separate structures that are mounted on or otherwise attached to the complementary piece 30. For example, in the embodiment shown in FIG. 5, the complementary piece 40 includes a unitary tab structure 42, preferably such that the complementary shape is clearly visible in most of the complementary piece, and additionally the tab or other smaller portion protrudes therefrom.

The complementary piece 30 can be made of any suitable and desired material. The complementary piece 30 can be made of the same or similar material as the panels 12,14, or can be made of a different type of material. Preferably, the complementary piece 30 is made of a material that is sufficiently rigid to resist bending, is sufficiently resilient to withstand handling by the user, and is capable of being securely adhered to the panel 12. Preferred materials includes paper (e.g., paperboard), lightweight plastic (e.g., thermoplastic such as polypropylene and PVC), and metal. In an embodiment, the complementary piece 30 includes a material that is markable with a pen or pencil, such that the user can customize it with markings as desired. The complementary piece 30 can have any desired appearance or features, such as colors, finishes, designs, printing, and/or textures. For example, the complementary piece 30 can have a color, image, or another visual or textural feature that is different from the panel 12, such that it is readily distinguishable from the panel 12.

Figure 6:
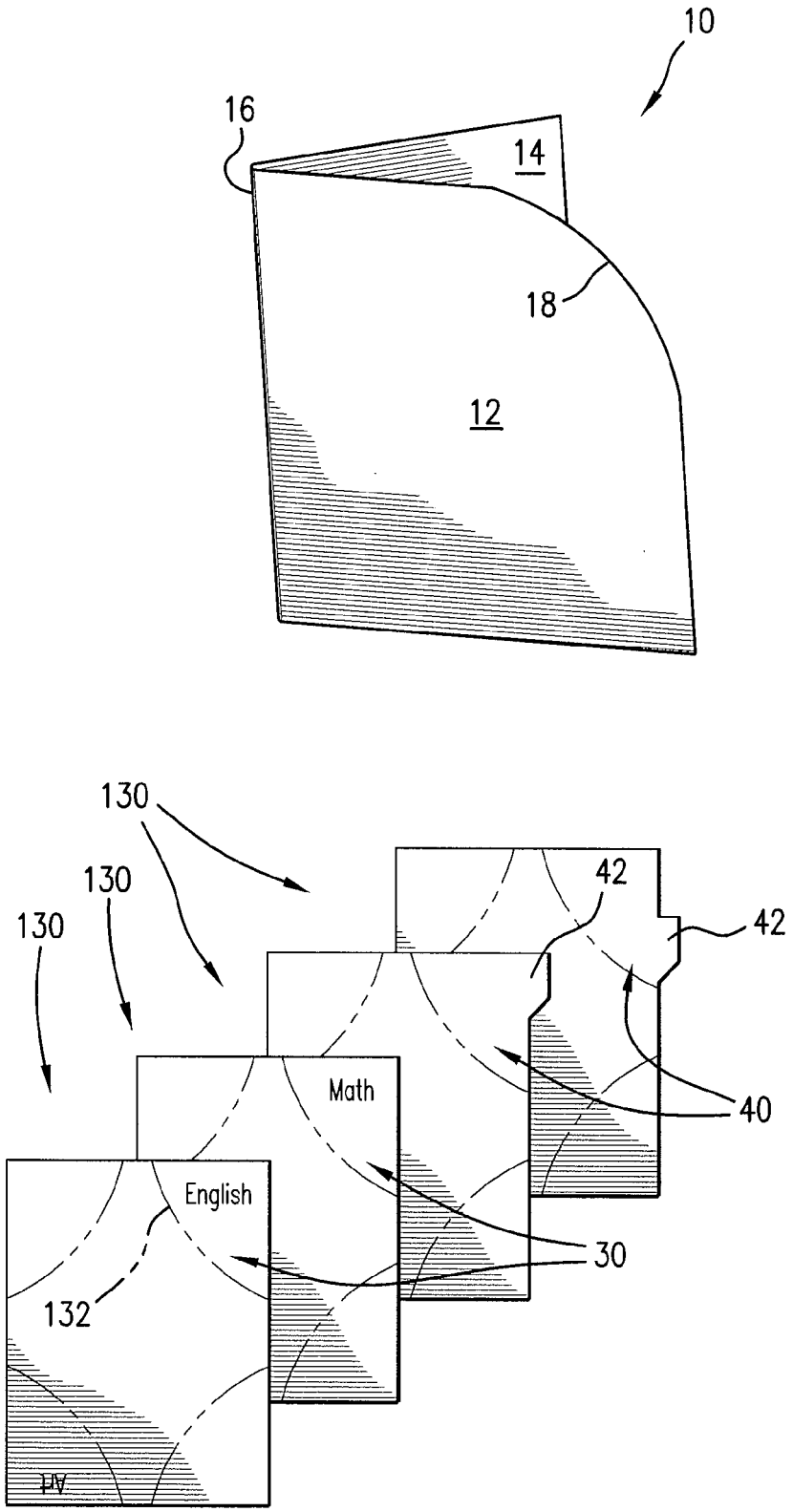
FIG. 6 is an illustration of a kit for a customizable folder comprising a plurality of complementary pieces according to another embodiment of the invention.

In an embodiment, one or more complementary pieces 30 are provided on sheets 130 as shown in FIG. 6. A line of weakness 132, such as a score line, delineates one or more complementary pieces 30 on each sheet. Multiple lines of weakness 132 can be provided on the sheet 130 to define a particular configuration of the complementary piece 30 or to define a plurality of complementary pieces 30. Preferably, each sheet 130 includes a plurality of complementary pieces 30. The user can select a desired complementary piece 30 configuration, tear it off the sheet 130 along the line of weakness 132, and affix it to the panel 12.

The complementary piece 30 is attached to the panel 12 by any suitable and desired manner. Preferably, the complementary piece 30 is attached adjacent the edge 18, to an inner surface of the panel 12, i.e., the surface facing the second panel 14 when the folder 10 is in the closed position.

Any suitable securing mechanism can be used, including adhesives, clips, and staples. Preferably, an adhesive is used. An adhesive can be provided on any surface of the panel 12 and/or the complementary piece 30 that contacts the other, i.e., any surface within the overlapping area 36. For example, an adhesive can be provided on a surface of the panel 12 and/or complementary piece 30 that engages the other and that corresponds to an area confined by line 90 shown in FIG. 4.

Any adhesive typically used with the material of the panel 12,14 or of the complementary piece 30 can be used. Types of suitable adhesives include repositionable, removable, permanent, remoistenable, hot melt, pressure seal (cohesive), cold glue, and combinations and mixtures thereof. The adhesive can be provided in the form of transfer tapes, pressure sensitive tapes and the like, which usually will have a removable protective cover thereon.

A removable protective cover, such as a peel-off cover 93, can be provided over the adhesive to protect the adhesive from engaging a surface until it is ready to be used. When the protective cover is removed, the adhesive is exposed and/or activated and is able to engage the panel 12 and complementary piece 30 to form a sealing arrangement therebetween.

Depending on the type of adhesive used, the sealing arrangement between the panel 12 and the complementary piece 30 can be permanent or releasable. When the sealing arrangement is releasable, the panel 12 and complementary piece 30 are preferably attached and separated by pressing and pulling by hand. The releasable sealing arrangement can be configured to allow repeated sealing and release. When a complementary piece 30 is released from the panel 12, the same or a different complementary piece 30 can be used in subsequent sealing arrangements.

In an embodiment, a kit is provided for making a customizable folder according to the invention. The kit comprises a folder 10 of a predetermined shape, with at least one edge portion 60 missing therefrom, and one or more complementary pieces 30 for attaching to the folder 10 adjacent the missing edge portion 60 for completing the predetermined shape. Preferably, the kit comprises multiple complementary pieces 30, which can have different appearances so that the user can select a complementary piece 30 desired for a particular purpose. FIG. 6 shows an exemplary kit, which includes multiple complementary pieces 30,40 of different configurations provided on sheets 130.

The customizable folder according to the invention can optionally include one or more of various features known to be used in a folder. Such features include pockets 20,22, which can be formed by folding the blank folder material and securing side edges thereof to the panels 12,14, as shown in FIG. 1. Alternatively, pockets 20,22 can be provided as separate structures that are attached to the panels 12,14. The folder 10 can include a three-ring binding mechanism 50 or other fastener mechanism, such as at or near the fold line 16. In an alternative embodiment, however, no such fastener or binding mechanism and/or no pockets are provided. The panels 12,14 can be formed unitarily, from a single piece of blank material as described above, or can be provided as separate structural pieces that are joined along an edge thereof. The panels 12,14 and the complementary piece 30 can include a laminated material. It will be understood that the folder can be adapted to include any of these and other known features of a typical folder as desired and suitable, which features can be provided in a manner known in the art.

The present customizable folder provides many advantages over the conventional stock folder. For example, the user can easily customize the folder's exterior appearance by attaching a complementary piece to the cover, thus creating a personalized visual effect "on demand." When the folder is provided with multiple complementary pieces, the user can select and modify the desired folder configuration by attaching a selected complementary piece. The present customizable folder also can be configured, for example, with releasable or reusable adhesives, to permit multiple changes of complementary piece.

As used herein, the term "about" should generally be understood to refer to both the corresponding number and a range of numbers. In addition, all numerical ranges herein should be understood to include each whole integer within the range. While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A folder comprising:

a first panel having a first predetermined exterior shape, with an edge portion missing therefrom, the first panel being adapted to receive thereto a complementary piece configured to substantially complete the first predetermined shape;

a second panel having a second predetermined shape and hinged to the first panel along a hinge line, wherein the first and second predetermined shapes are substantially the same; and a complementary piece including:

an overlapping area configured to be attached to the first panel, and a complementary portion shaped and dimensioned substantially as the missing edge portion to substantially complete the first predetermined shape when the overlapping area is overlapped with and attached to the first panel.

2. The folder of claim 1, wherein the first predetermined shape is substantially regular.

3. The folder of claim 1, wherein the first predetermined shape is substantially rectangular.

4. The folder of claim 3, wherein the missing edge portion is a corner portion of the rectangle opposite the hinge line.

5. The folder of claim 1, further comprising:

an adhesive disposed on a surface of the first panel or the overlapping area of the complementary piece, for providing sealing arrangement between the first panel and the complementary piece; and a removable protective cover covering the adhesive.

6. The folder of claim 1, further comprising a completely removable corner shaped and dimensioned substantially as the missing edge portion and removably attached to the first panel by a line of weakness extending between two edges of the first panel.

7. The folder of claim 1, wherein the second panel has an edge portion missing from the second predetermined shape and is adapted to receive thereto a complementary piece configured to substantially complete the second predetermined shape.

8. The folder of claim 1, wherein the complementary piece has a different appearance from the first panel.

9. The folder of claim 6, wherein the first panel is configured to adhesively affix the complementary piece.

10. A kit for a folder, comprising:

a folder comprising:

a first panel having a first predetermined shape, with an edge portion missing therefrom, the first panel being adapted to receive thereto a complementary piece configured to substantially complete the first predetermined shape;

a second panel having a second predetermined shape and hinged to the first panel along a hinge line; and a plurality of complementary pieces each including:

an overlapping area configured to be attached to the first panel to, and a complementary portion shaped and dimensioned substantially as the missing edge portion to substantially complete the first predetermined shape when the overlapping area is overlapped with and attached to the first panel;

wherein the first and second predetermined shapes are substantially the same.

11. The kit of claim 10, wherein the first predetermined shape is substantially rectangular.

12. The kit of claim 10, further comprising an adhesive disposed on a surface of the first panel or the overlapping area of the complementary pieces.

13. The kit of claim 12, further comprising a removable protective cover covering the adhesive.

14. The kit of claim 10, wherein the complementary pieces have a different appearance from the first panel.

15. The kit of claim 10, wherein at least two of the complementary pieces have different appearances from each other.

16. The kit of claim 10, wherein at least one complementary piece includes a tab.

17. The kit of claim 10, wherein the second panel has an edge portion missing from the second predetermined shape and is adapted to receive thereto a complementary piece configured to substantially complete the second predetermined shape, and wherein at least one complementary piece is configured to substantially complete the second predetermined shape.

18. The folder of claim 1, wherein the complementary piece is of separate construction from the first panel.

19. A folder comprising:

a first panel having a first, substantially rectangular, predetermined exterior shape, with an edge portion missing therefrom, the first panel being adapted to receive thereto a complementary piece configured to substantially complete the first predetermined shape;

a second panel having a second predetermined shape and hinged to the first panel along a hinge line; and a complementary piece including:

an overlapping area configured to be attached to the first panel, and a complementary portion extending from the overlapping area and configured and dimensioned substantially as the missing edge portion to substantially complete the first predetermined shape when the overlapping area is overlapped with and attached to the first panel.

20. The folder of claim 18, wherein the missing edge portion is a corner portion of the rectangle opposite the hinge line.

21. The folder of claim 18, further comprising an adhesive disposed on a surface of the first panel or the overlapping area of the complementary piece, for providing sealing arrangement between the first panel and the complementary piece; and a removable protective cover covering the adhesive.

22. The folder of claim 1, wherein the overlapping area overlaps part of the first panel when attached to the first panel.

23. The folder of claim 1, wherein the overlapping area and complementary portion are of unitary construction.

24. The folder of claim 1, wherein the first and second panel are folder cover panels.

25. The folder of claim 16, wherein the tab extends from the complimentary portion.

* * * * *